US006069587A

United States Patent [19]

Lynch et al.

[11] Patent Number: 6,069,587

[45] Date of Patent: May 30, 2000

[54] MULTIBAND MILLIMETERWAVE RECONFIGURABLE ANTENNA USING RF MEM SWITCHES

[75] Inventors: Jonathan Lynch, Ornard; Stan Livingston, Fullerton; Jar J. Lee, Westlake Village; Robert Y. Loo; Juan Lam, both of Agoura Hills; Adele Schmitz, Newbury Park; Debabani Choudhury, Woodland Hills; Julia Brown, Santa Monica, all of Calif.; Daniel J. Hyman, Cleveland Hts., Ohio; Brett Warneke, Berkeley, Calif.

[73] Assignee: Hughes Electronics Corporation, El Segundo, Calif.

[21] Appl. No.: 09/079,805

[22] Filed: May 15, 1998

[51] Int. Cl.[7] ..... H01Q 1/38

[52] U.S. Cl. ..... 343/700 MS; 343/702; 343/831

[58] Field of Search ..... 343/700 MS, 702, 343/831, 846, 848; H01Q 1/38

[56] References Cited

U.S. PATENT DOCUMENTS

| | | | |
|---|---|---|---|
| 4,751,513 | 6/1988 | Daryoush et al. | 343/700 MS |
| 4,843,400 | 6/1989 | Tsao et al. | 343/700 MS |
| 5,541,614 | 7/1996 | Lam et al. | 343/792.5 |
| 5,633,645 | 5/1997 | Day | 343/700 MS |
| 5,874,919 | 2/1999 | Rawnick et al. | 343/700 MS |

*Primary Examiner*—Don Wong
*Assistant Examiner*—Shih-Chao Chen
*Attorney, Agent, or Firm*—Bradley K. Lortz; Vijayalakshmi D. Duraiswamy; Michael W. Sales

[57] ABSTRACT

A multiband millimeterwave antenna system for communicating signals in multiple frequency bands is disclosed. A main antenna body is connected to antenna extensions by micro-electro-mechanical switches. By opening and closing the switches, the length of the antenna can be altered. The antenna is coupled to a microstrip feed line by an aperture. A series of matching stubs match the impedance of the feed line for the various signal frequencies.

19 Claims, 2 Drawing Sheets

MULTIBAND MILLIMETERWAVE RECONFIGURABLE ANTENNA USING RF MEM SWITCHES

This invention was made with Government support under Contract No. N66001-96-C-8636 awarded by the Department of the Navy. The Government has certain rights in this invention.

BACKGROUND OF THE INVENTION (a) Technical Field of the Invention

This invention relates to multifrequency antennas. More particularly, it relates to reconfigurable millimeterwave dipole antennas that can transmit and receive signals in multiple frequency bands.

(b) Description of Related Art

In communications applications, it is often desirable to transmit or receive signals in more than one frequency. Common dipole antennas are designed to transmit and receive in only one frequency. These antennas are typically constructed so that the length of the antenna is equal to one-half of the wavelength of the operational frequency of the antenna. At this frequency, the signal will resonate in the antenna and maximum power transfer will occur. The half-wavelength frequency also allows the antenna to transmit and receive with a broad frequency band.

Prior designs have attempted to modify the above-described dipole antenna structures to allow them to transmit and receive at more than one frequency. These designs have relied primarily on providing its frequencies at higher multiples of the half-wavelength frequency. For example, a particular design may allow the same antenna to resonant at a signal frequency equal to one full wavelength of the signal, as well as a frequency that is equal to one-half of the wavelength of the signal. However, this type of passive multi-frequency antenna has several short comings. First, the higher-multiple wavelengths do not have as large a bandwidth as the half-wavelength frequency. Also, there is no isolation between the two frequencies. If a passive dual-frequency antenna is transmitting at one frequency, it may receive interference from signals that are being received at the other frequency. In addition, these passive antennas operate best when the two frequencies are each multiples of a common half-wavelength, thus limiting the possible frequencies that a single antenna could effectively achieve.

A known approach to avoiding some of the problems of a passive multi-frequency antenna is to use two separate antennas having a switching mechanism that is used to select between the antennas. In this design, the antennas are typically positioned alongside one another. The antennas are of different lengths, and each antenna is used to transmit or receive at a separate frequency. The switching mechanism selects between the two antennas based upon which frequency is desired. This design allows any two frequencies to be used, but suffers from other drawbacks. The physical proximity of the antennas may cause them to become electromagnetically coupled to one another. This coupling could distort the effective operating frequencies of the antennas and make designing the antenna more difficult. A further problem with the switched antenna approach is the fact that two antennas take up twice as much space as a single antenna. This is a significant problem when designing dense circuits to fit in a constrained area, such as millimeterwave antennas on printed circuit boards or on integrated circuits. As more frequencies are added, thereby requiring additional antennas, this problem is compounded.

A known solution is to use a switching mechanism that changes the effective length of the antenna rather than switch in an entirely new antenna. The physical layout area required for this device would be much less than for a multiple-antenna system. U.S. Pat. No. 5,541,614, issued to Lam et. al., discloses a switched-dipole antenna for millimeterwave applications. The Lam patent discloses the use of micro-electro-mechanical (MEM) switches to add additional segments to a dipole antenna to increase the length of the antenna and allow the system to operate at multiple frequencies.

SUMMARY OF THE INVENTION

The present invention is an improvement over known multi-frequency reconfigurable antenna systems that use micro-electro-mechanical (MEM) switches to adjust the length of an antenna. According to the present invention, antenna length is adjusted by coupling additional antenna segments to a base antenna segment. The antenna system has a series of stubs that match the impedance of a feed line for all of the frequencies that the antenna is designed to communicate in. Thus, when the MEM switches are open, electrical isolation is established between the antenna segments, thereby allowing the antenna to operate in one frequency range without interference from the other frequency ranges. Accordingly, the MEM switches couple additional segments to the antenna, thereby allowing the antenna to operate in different frequency ranges.

In one embodiment of the invention, an antenna extension is coupled to a main antenna body by a micro-electro-mechanical switch. The main antenna body and the antenna extension are fabricated on an antenna substrate. A feed line is fabricated on a separate substrate below the antenna substrate. A ground plane separates the antenna substrate and the feed line substrate, and an aperture in the ground plane transmits signals between the feed line and the main antenna body. Matching stubs are coupled on the feed line to match the impedance of the feed line for each frequency band the antenna system is designed to communicate in.

In one aspect of the invention, the above-referenced matching stubs include a first matching stub and a second matching stub. The length of the first matching stub is one-quarter of the wavelength of a first frequency signal the antenna system is designed to communicate, and the length of a second matching stub is one-quarter of the wavelength of a second frequency signal that the antenna system is designed to communicate at. The matching stubs and the feed line may all be connected at a stub junction and may all lie in the same plane.

In a further aspect of the invention, a second antenna extension is connected to the above-referenced main antenna body by a second MEM switch to allow the antenna system to communicate at additional frequencies. One or two additional matching stubs are connected to the feed line for matching the impedance of the feed line for the additional frequencies. Instead of being connected to the main antenna body, the second antenna extension could alternatively be connected to the first antenna extension by a second MEM switch.

A further embodiment of the invention is a method of transmitting a signal comprising the steps of placing a signal onto a feed line, matching the impedance of the feed line by coupling a first matching stub to the feed line corresponding to each frequency the antenna system is designed to communicate, transmitting the signal through an aperture to a main antenna body, opening a MEM switch between the main antenna body and an antenna extension if the signal is within a first frequency band and closing the MEM switch if the signal is within a second frequency band, and radiating the signal from the main antenna body if the signal is within the first frequency band or from the main antenna body and the antenna extension if the signal is within a second frequency band.

Yet another embodiment of the present invention is a method of receiving a signal comprising the steps of opening a MEM switch that connects a main antenna body to an antenna extension if the signal if within a first frequency band and closing the switch if the signal is within a second frequency band, receiving the signal at the main antenna body if the signal is within a first frequency band or at the main antenna body and the antenna extension if the signal is within a second frequency band, transmitting the signal through an aperture to a feed line, coupling one matching stub to the feed line to match the impedance of the feed line for each frequency the antenna system is designed to communicate at, and receiving the signal at the feed line.

BRIEF DESCRIPTION OF THE DRAWINGS

These and other features of the present invention will become more apparent when a detailed consideration of the invention is taken in conjunction with the drawings herein.

DETAILED DESCRIPTION

Figure 1:
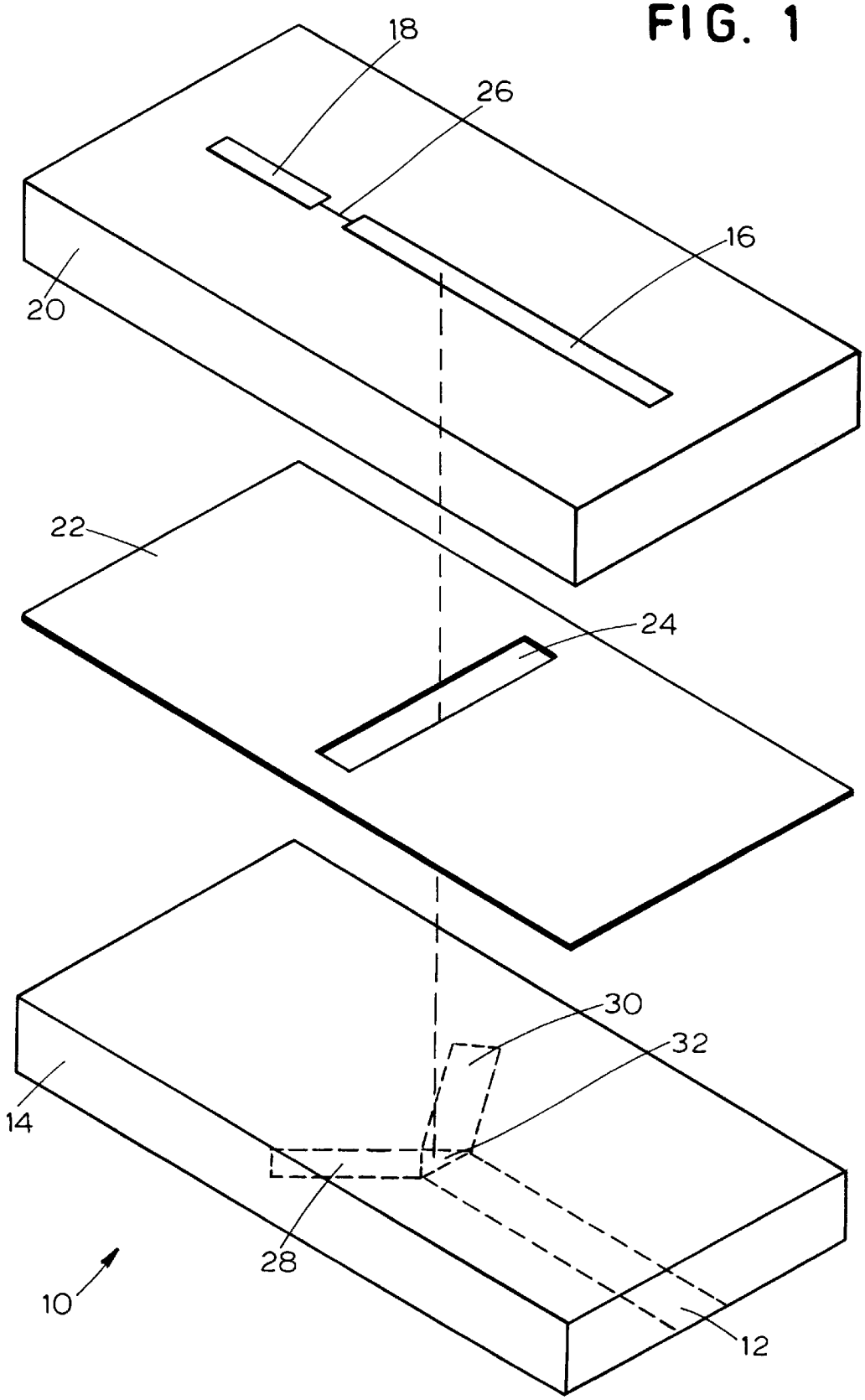
FIG. 1 illustrates a dual-frequency millimeterwave dipole antenna embodying the present invention. The antenna is fabricated on two substrates separated by a ground plane.

FIG. 1 shows a dual-band millimeterwave antenna system 10 embodying the present invention. The antenna system 10 is capable of communicating signals in two different frequency ranges. These two ranges will be referred to throughout this disclosure as the high frequency signal and the low frequency signal. A microstrip feed line 12 is printed on a microstrip substrate 14. A main antenna body 16 and an antenna extension 18 are printed on a separate antenna substrate 20. A common ground plane 22 is located between the two substrates. Communication signals pass between the microstrip feed line 12 and the main antenna body 16 through an aperture 24 in the ground plane 22. The ground plane 22 provides shielding that prevents the radiating energy from the microstrip feed line 12 from interfering with the operation of the main antenna body 16 and the antenna extension 18.

The antenna system 10 changes from a first frequency mode to a second frequency mode by selectively opening or closing a micro-electro-mechanical (MEM) switch 26 that connects the main antenna body 16 to the antenna extension 18. When the MEM switch 26 is open, there is electrical isolation between the main antenna body 16 and the antenna extension 18. In this configuration, the effective antenna length of the antenna system 10 is the length of the main antenna body 16. In the preferred embodiment, the length of the main antenna body 16 is chosen such that it is equal to one-half of the wavelength of the high frequency signal, which allows the high frequency signal to resonant in the main antenna body 16.

When the MEM switch 26 is closed, the main antenna body 16 and the antenna extension 18 are electrically connected. The effective antenna length of the antenna system 10 is then the length of the main antenna body 16 plus the length of the antenna extension 18. In the preferred embodiment, the length of the antenna extension 18 is chosen such that the length of the main antenna body 16 plus the length of the antenna extension 18 equals one-half of a wavelength of the low frequency signal.

The microstrip feed line 12 is terminated by a high frequency matching stub 28 and a low frequency matching stub 30. The high frequency matching stub 28 is designed so that it is the length of one-quarter of the wavelength of the high frequency signal, and the low frequency matching stub 30 is designed so that it is the length of one-quarter of the wavelength of the low-frequency signal. The high frequency stub 28 and the low frequency stub 30 join the microstrip feed line 12 at a stub junction 32.

A matching stub that is one-quarter of a wavelength long will generate a short circuit at the entrance to the stub when a signal with a frequency corresponding to that wavelength passes through the stub. Thus, when a signal corresponding to the high frequency passes through the microstrip feed line 12 and the high frequency stub 28, the high frequency stub 28 creates a short circuit at the stub junction 32. This allows maximum power flow between the microstrip feed line 12 and the main antenna body 16. Similarly, when a signal corresponding to the low frequency passes through the microstrip feed line 12, a short circuit appears on the junction 32 from the low frequency matching stub 30. This short allows maximum power transfer between the microstrip feed line 12 and the main antenna body 16 at the low frequency.

As long as one stub with a length equal to one-quarter of the wavelength of the signal on the microstrip feed line 12 is connected to the junction 32, a short circuit will appear at the stub junction 32 and maximum power transfer will occur between the microstrip line 12 and the main antenna body 16. Thus, as more antenna extensions and MEM switches are added to the antenna system 10 to allow the antenna system 10 to operate at additional frequencies, more matching stubs should be added to the stub junction 32.

It is desirable to keep the angle between the matching stubs 28 and 30 as large as possible. This will space the stubs further away from one another and reduce the RF coupling between the stubs 28 and 30. It will also keep the size of the stub junction 32 as small as possible. As the size of stub junction 32 increases, the stub junction 32 can start adding non-ideal impedances to the antenna system 10. To correct for these non-ideal factors, the lengths of the stubs 28 and 30 should be adjusted from the ideal one-quarter wavelength, thus potentially causing design complications. It is also desirable to keep the stubs 28 and 30 as far away from the microstrip line 12 as possible to avoid any RF coupling between the stubs 28 and 30 and the microstrip line 12. One manner with which to maximize the separation between all of the stubs and the microstrip line 12 is to separate them by an angle equal to $$\frac{360}{\text{Number of Stubs} + 1}.$$

Thus, in the preferred embodiment of FIG. 1, each stub is 120 degrees away from the other stub and the microstrip line 12.

It is necessary to choose a length for the aperture 24 that will maximize antenna performance. For a single frequency antenna, the length of the aperture 24 would be chosen to be equal to one-half of the wavelength of the design signal frequency. In a multiple-frequency system, however, there is more than one design wavelength. In these multiple-frequency systems, the aperture 24 is chosen to be equal to one-half of the wavelength of the highest frequency signal. This corresponds to the signal with the smallest wavelength. One-half of the smallest wavelength is chosen for several reasons. First, one-half of a wavelength is the optimal length for maximum power transfer. Thus, the highest frequency signal will have optimal tuning. Second, the smallest wavelength is chosen to prevent higher order modes from appearing on any shorter wavelength signals. For example, if the aperture 24 were designed such that it is one-half of the wavelength of the longest wavelength signal, then the aperture 24 would be longer than one-half of the shorter wavelength signal. This would allow higher-ordered modes to appear in the aperture 24 when passing the shorter wavelength signal, which would reduce power transfer and signal quality for that signal.

In the preferred embodiment, the aperture 24 is one-half of the wavelength of the shorter wavelength signal, and is too short to allow a full half-wavelength of the longer wavelength signal to appear in the aperture 24. This causes the aperture 24 to have an inductive component when communicating the longer wavelength signal. The inductive component of the aperture 24 reduces the ability of the aperture 24 to couple to the microstrip line 12. This inductive aperture can be compensated for by reducing the length of the matching stub 30 that corresponds to the low frequency signal. Reducing the length of the stub 30 to less than one-quarter of a wavelength will cause the stub 30 to appear capacitive. The stub length should be reduced enough to allow the capacitive component of the stub 30 to resonate out the inductive component of the aperture 24.

Millimeterwave antenna systems embodying the present invention may be fabricated using printed circuit technology. The microstrip line 12 and the matching stubs 28 and 30 may be printed directly onto a circuit board that serves as the microstrip substrate 14. The main antenna body 16 and the antenna extension 18 may be printed onto a second circuit board that will serve as the antenna substrate 20. The MEM switch 26 can be fabricated on a semiconductor wafer and die cut and inserted onto the printed circuit board serving as the antenna substrate 20. The ground plane 22 may be printed on either circuit board. A low loss adhesive is used to bond the microstrip substrate 14 and the antenna substrate 20 together.

In the preferred embodiment, the switching mechanism connecting the main antenna body 16 and the antenna extension 18 is the MEM switch 26. While it is possible to use other types of switches to connect the main antenna body 16 to the antenna extension 18, such as a gallium arsenide semiconductor switch, the MEM switch 26 is preferred because it has both a very low insertion loss when closed and a high isolation value when open.

Figure 2A:
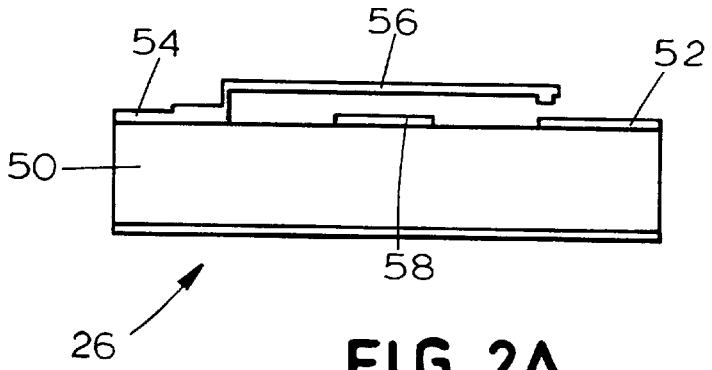
FIG. 2A is a side elevational view of the micro-electro-mechanical switch shown in FIG. 1, wherein the switch is in the open position.

FIG. 2A is a more detailed view of the MEM switch 26 in the 'open' position. The MEM switch 26 may be fabricated using standard integrated circuit technology. The MEM switch 26 is constructed on a substrate 50. In the preferred embodiment, GaAs is used as the substrate 50. Other materials, such as InP, silicon, quartz, or even ceramics may be used as well. On top of the substrate 50 is an input line 52, an output line 54, an armature 56, and a substrate electrode 58.

Figure 3:
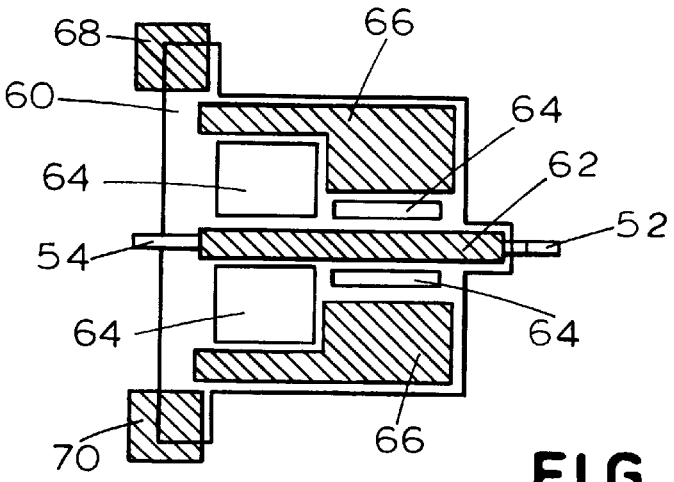
FIG. 3 is a more detailed view of the micro-electro-mechanical switch shown in FIGS. 1, 2A, and 2B.

A detailed overview of the armature 56 is shown in FIG. 3. A beam structural layer 60 provides most of the support for the armature 56. Printed underneath the structural layer 60 and extending from one end of the armature 56 to the other is a conducting line 62. One end of the conducting line 62 is electrically connected to the output line 54. The other end of the conducting line 62 is suspended above the input line 52. When the MEM switch 26 is in the open position, the conducting line 62 is separated and electrically isolated from the input line 52 by an air gap. The armature 56 also includes an armature electrode 66 fabricated directly above the substrate electrode 58.

Figure 2B:
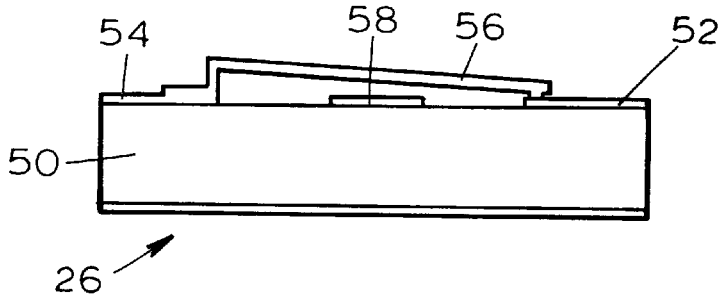
FIG. 2B is a side elevation view of the micro-electro-mechanical switch shown in FIGS. 1 and 2A, wherein the switch is in the closed position.

The armature electrode pad 66 is positioned on the side of the conducting line 62. As shown in FIGS. 2A and 2B, a substrate electrode 58 is located below the armature 56. The MEM switch 26 is actuated by establishing a voltage difference between the armature electrode 66 and the substrate electrode 58. This creates an electrostatic force that draws the armature electrode 66, and hence the armature 56, towards the substrate electrode 58. As the armature 56 is drawn towards the substrate electrode 58, it will bend and the conducting transmission line will contact the input line 52. This creates an electrical connection between the input line 52 and the output line 54 through the conducting line 62. This 'closed' switch position is shown in FIG. 2B. The large surface area of the armature electrode 66 reduces the actuation voltage required to close the MEM switch 26, and the use of the bias pad 66 eliminates the need for additional external components for DC biasing, such as a "bias tee," which greatly simplifies device integration.

An armature electrode via 68 and an electrode via 70 are located at the base of the MEM switch 26. Conducting lines through these vias 68, 70 are used to the voltage difference between the armature electrode 66 and the substrate electrode 58. The armature electrode via 68 is electrically connected to the armature electrode 66, and the substrate electrode via 70 is electrically connected to the substrate electrode 58. The use of the armature electrode 66 in the MEM switch 26 does not ordinarily significantly interfere with the performance of the antenna system 10. However, the vias 68 and 70 that connect the armature electrode 66 and the substrate electrode 58 to bias lines below the ground plane 22 can affect the performance of the antenna system 10. In the preferred embodiment, the vias 68 and 70 are placed about one-half of a wavelength of the operating frequency away from the aperture 24 to reduce the interference with the antenna.

The input line 52, output line 54, and conducting line 62 are typically made of metal and may be fabricated using standard integrated circuit technology such as masking and resist lift-off. Gold is the preferred metal to use because of its low resistivity, but other metals may also be suitable. The MEM switch 26 generally exhibits a low insertion loss when in the closed position and a high isolation between the input line 52 and the output line 54 when the switch 26 is open. This prevents the antenna system 10 from receiving interference from one frequency band while communicating in the other. In addition, the MEM switch 26 is capable of conducting a broad range of frequencies with little signal variation.

There are many other embodiments possible for the MEM switch 26. Other embodiments may be found in U.S. Pat. No. 5,121,089, issued to Larry Larson, and "Design and Fabrication of Broadband Surface-Micromachined Micro-Electro-Mechanical Switches for Microwave and Millimeter-Wave Applications," a co-pending application filed concurrently with the present application. The present invention should not be construed to be limited to the use of a particular MEM switch described herein.

Thus, it can be understood from the foregoing detailed description that the disclosed reconfigurable antenna embodying the invention provides several advantages. For example, additional antenna segments can easily be added to the antenna system to allow the system to communicate in additional frequency bands. The matching stubs match the impedance of the feed line to allow maximum power transfer from the feed line to the antenna over multiple frequencies, and the sizing of the aperture allows for maximum power transfer at the higher design frequency and prevents higher-order modes from appearing in the aperture for the other design frequencies.

As can be surmised by one skilled in the art, there are many more configurations of the present invention that can be used other than the ones presented herein. For example, additional MEM switches and antenna extensions may be used to create an antenna system capable of communicating in more than two frequency bands. In this case, more matching stubs will have to be added for impedance matching at the additional frequencies. FIG. 1 is only one embodiment of the present invention. The present invention is not limited to a dual-band antenna system and may be implemented in a system capable of communicating in three or more frequency bands. In addition, the antenna systems need not be constructed in a multi-planar fashion. A single plane could be used to house all components. The antenna may also be directly connected to the microstrip feed line rather than through the use of an aperture. In addition, switches other than MEM switches may be used to connect the main antenna body and the antenna extensions. It is therefore intended that the foregoing detailed description be regarded as illustrative rather than limiting and that it be understood that it is the following claims, including all equivalents, that are intended to define the scope of this invention.

What is claimed is:

1. A multiband antenna system for transmitting and receiving multiple frequency signals, comprising a) a first substrate;

b) a main antenna body disposed on the first substrate;

c) an antenna extension disposed on the first substrate;

d) a switch coupled to the main antenna body and the antenna extension, the switch adapted to selectively couple the main antenna body to the antenna extension;

e) second substrate;

f) a feed line disposed on the second substrate, the feed line adapted to transmit signals to and from the antenna;

g) a first matching stub matched to a first frequency, the first matching stub being disposed on the second substrate and coupled to the feed line;

h) a second matching stub matched to a second frequency, the second matching stub being disposed on the second substrate and coupled to the feed line; and i) a ground plane separating the first substrate from the second substrate, the ground plane having an aperture that allows electromagnetic coupling of the first and second frequencies between the main antenna body and the feed line.

2. The multiband antenna system of claim 1, wherein the switch comprises a micro-electro-mechanical switch.

3. The multiband antenna system of claim 2, wherein the length of the first matching stub is one-quarter of the wavelength of a first frequency signal.

4. The multiband antenna system of claim 3, wherein the length of the second matching stub is less than one-quarter of the wavelength of a second signal.

5. The multiband antenna system of claim 3, wherein the length of the second matching stub is one-quarter of the wavelength of a second signal.

6. The multiband antenna system of claim 2, wherein the length of the main antenna body is equal to one-half of the wavelength of the first frequency signal, and the length of the main antenna body plus the length of the antenna extension is equal to one-half the wavelength of the second frequency signal.

7. The multiband antenna system of claim 2, wherein a length of the aperture is one-half of the wavelength of the first frequency signal.

8. The multiband antenna system of claim 2, wherein the first matching stub, the second matching stub, and the feed line are electrically coupled by a stub junction.

9. The multiband antenna system of claim 8, wherein the first matching stub, the second matching stub, and the feed line all lie in the same plane.

10. The multiband antenna system of claim 9, wherein each of the first matching stub, the second matching stub, and the feed line are separated from one another by 120 degrees.

11. The multiband antenna system of claim 2, further comprising:

a) a second antenna extension disposed on the first substrate;

b) a second micro-electro-mechanical switch connected to the main antenna body and the second antenna extension for selectively coupling the second antenna extension to the main antenna body; and c) a third matching stub disposed on the second substrate and coupled to the feed line.

12. The multiband antenna system of claim 11, further comprising a fourth matching stub disposed on the second substrate and coupled to the feed line.

13. The multiband antenna system of claim 2, further comprising:

a) a second antenna extension disposed on the first substrate;

b) a second micro-electro-mechanical switch connected to the first antenna extension and the second antenna extension for selectively coupling the second antenna extension to the first antenna extension; and c) a third matching stub disposed on the second substrate and coupled to the feed line.

14. The multiband antenna system of claim 13, further comprising a fourth matching stub disposed on the second substrate and coupled to the feed line.

15. The multiband antenna system of claim 8, wherein the stub junction is aligned with the aperture in the ground plane.

16. A multiband antenna system for transmitting and receiving multiple frequency signals, comprising:

a) a first substrate;

b) a main antenna body disposed on the first substrate;

c) an antenna extension disposed on the first substrate;

d) a micro-electro-mechanical switch coupled to the main antenna body and the antenna extension, the switch adapted to selectively couple the main antenna body to the antenna extension;

e) second substrate;

f) a feed line disposed on the second substrate, the feed line adapted to transmit signals to and from the antenna;

g) a first matching stub matched to a first frequency, the first matching stub being disposed on the second substrate and coupled to the feed line;

h) a second matching stub matched to a second frequency, the second matching stub being disposed on the second substrate and coupled to the feed line;

i) a ground plane separating the first substrate from the second substrate, the ground plane having an aperture that allows electromagnetic coupling of the first and second frequencies between the main antenna body and the feed line; and j) an armature electrode via and a substrate electrode via, wherein said vias are connected at one end to the micro-electro-mechanical switch and extend through the ground plane to connect at the other end to the feed line substrate, and wherein said vias are located one-half of a wavelength away from the aperture.

17. A method for transmitting multiple frequency signals, comprising a) placing a signal onto a feed line;

b) transmitting the signal from the feed line to a main antenna body through an aperture in a ground plane that separates the main antenna body and the feed line;

c) impedance matching the feed line to the aperture by coupling a first matching stub and a second matching stub to the feed line, the first matching stub matching the feed line to the aperture over a first frequency band and the second matching stub matching the feed line to the aperture over a second frequency band;

d) opening a micro-electro-mechanical switch between the main antenna body and an antenna extension if the signal is within a first frequency band, and closing the micro-electro-mechanical switch between the main antenna body and the antenna extension if the signal falls within a second frequency band; and e) radiating the signal from the main antenna body and the antenna extension if the signal is within the first frequency band, and radiating the signal from the main antenna body if the signal is within the second frequency band.

18. The method of claim 17, wherein the step of impedance matching, wherein the first matching stub is approximately one-quarter of the wavelength of the signal placed on the feed line.

19. A method for receiving multiple frequency signals, comprising:

a) opening a micro-electro-mechanical switch between a main antenna body and an antenna extension if a signal to be received is within a first frequency band, and closing the micro-electro-mechanical switch between the main antenna body and the antenna extension if the signal to be received is within a second frequency band;

b) receiving a signal at the main antenna body and the antenna extension if the signal is within a first frequency band, and receiving a signal at the main antenna body if the signal is within a second frequency band;

c) transmitting the signal from the main antenna body to a feed line through an aperture;

d) coupling first and second matching stubs to the feed line to match the impedance of the feed line to the aperture, wherein the first matching stub is matched to the aperture over a first frequency band and the second matching stub is matched to the aperture over a second frequency band; and e) receiving the signal at the feed line.

* * * * *